US007244157B2

(12) United States Patent
Simpson

(10) Patent No.: US 7,244,157 B2
(45) Date of Patent: Jul. 17, 2007

(54) HIGH-LIFT, LOW DRAG FIN FOR SURFBOARD AND OTHER WATERCRAFT

(76) Inventor: Douglas James Simpson, 912 I Ave., Coronado, CA (US) 82118

( * ) Notice: Subject to any disclaimer, the term of this patent is extended or adjusted under 35 U.S.C. 154(b) by 14 days.

(21) Appl. No.: 11/163,626

(22) Filed: Oct. 25, 2005

(65) Prior Publication Data

US 2007/0093154 A1 Apr. 26, 2007

(51) Int. Cl.
*B63B 3/38* (2006.01)

(52) U.S. Cl. ..... 441/79; 114/127; 114/140

(58) Field of Classification Search ..... 441/79; 114/39.15, 127, 129, 140, 274
See application file for complete search history.

(56) References Cited

U.S. PATENT DOCUMENTS

| | | | | |
|---|---|---|---|---|
| 2,081,868 | A * | 5/1937 | Hampden | 114/274 |
| 3,747,138 | A | 7/1973 | Morgan | 9/310 E |
| 3,845,918 | A | 11/1974 | White | 244/41 |
| 4,050,397 | A * | 9/1977 | Vanderleest | 114/274 |
| 4,320,546 | A | 3/1982 | Knox | 441/74 |
| 4,561,371 | A * | 12/1985 | Kelley et al. | 114/61.22 |
| 5,809,926 | A | 9/1998 | Kelsey | 114/274 |
| 6,101,963 | A | 8/2000 | Shen | 114/140 |
| 6,234,856 | B1 | 5/2001 | Woolley | 441/65 |
| 2002/0094733 | A1 | 7/2002 | Kershaw | 441/79 |

FOREIGN PATENT DOCUMENTS

EP 0 092 785 A2 * 11/1983

OTHER PUBLICATIONS

Translation for EPA 0092785.*

* cited by examiner

*Primary Examiner*—Sherman Basinger

(57) ABSTRACT

This invention discloses a fin, for use on a surfboard and other watercraft, of a low-drag, high-lift, high-aspect-ratio, low-sweepback-angle planform of symmetrical foil section, with a fit root section that has a forwardly projecting leading edge and cutaway at the trailing edge, alone or in combination with winglets placed on the vertical fin element so as to minimize tip-vortex drag, so as to make the surfboard or watercraft more maneuverable, easier to propel through the water, and to stabilize the surfboard or watercraft.

11 Claims, 16 Drawing Sheets

HIGH-LIFT, LOW DRAG FIN FOR SURFBOARD AND OTHER WATERCRAFT

FIELD OF THE INVENTION

The present invention relates to stabilizing fins for watercraft such as surfboards and other watercraft, and more particularly to a fin that not only stabilizes the surfboard or watercraft laterally and vertically, but also assists maneuverability and turning of the surfboard or watercraft.

BACKGROUND OF THE INVENTION

Aerodynamics and hydrodynamics have much in common because both disciplines involve the study of the movement of a fluid, air or water, past a structure. Surfing, and other water sports such as sailing, power boating, windsurfing, kite surfing, wakeboarding and water skiing, for example, thus share some common aspects derived not only from aerodynamic principles, but also from hydrodynamic principles. This disclosure relates to an invention intended primarily for use on surfboards, but given the teachings of this disclosure is easily practiced in or adaptable to sports involving other watercraft such as those mentioned.

The sport of surfing involves a complex interaction between surfboard, surfboard rider, and waves. As in the sports of skiing and snowboarding, and unlike other board-riding sports such as windsurfing, kite surfing, water skiing, and water boarding, surfers while surfing are propelled by the effects of gravity pulling the surfer down wave faces. Unlike other board sports, surfers after riding a wave toward shore typically must propel themselves back to the spot where they can catch the next wave.

Surfing requires more than simply sliding uncontrolled down a wave face; good surfers are able to control both surfboard speed and surfboard direction. Similarly, good surfboards are those that are capable of high speeds if the surfer so desires, are otherwise easily maneuverable, are easy to paddle, and are quick to catch waves. Surfboard speed and maneuverability depend on a variety of characteristics of the surfboard itself, and of attached surfboard appendages, known as fins, although some people have referred to surfboard fins as skegs. Modern surfboards uniformly use one, two, three, or four fins, but most commonly either one large center fin, or one large center fin, and two side fins as shown in FIGS. 5, 6, 10, and 11. In this section, the term "surfboard" is meant to include the attached fins, unless otherwise indicated.

Within certain limits, surfboard speed typically is accomplished by adjusting the pitch of the board in relationship to the wave face. Pitch is the longitudinal angle the surfboard makes from the horizontal. Surfboard pitch is controlled by the surfer moving forward toward the nose of the board, or backward toward the tail of the board, and thus adjusting the center of gravity of the surfer and surfboard system in relation to the center of buoyancy such that the board slide down the wave face with the correct inclination such that it either planes on the water or stalls in the water, to speed up or to slow down the board. Generally speaking and to certain limits, surfboard speed is increased by moving forward on the board and decreased by moving backward on the board. All else being equal, a surfboard—including its fins—with less drag will move faster through the water because drag is the force of resistance to forward motion. Thus with less resistance, a board with less drag can move faster through the water. Surfboard speed is thus is inversely related to the surfboard's drag.

Likewise, surfboards are easier to paddle where they have less drag, again because drag is the force of resistance to the surfboard's forward motion. Thus a surfer paddling a surfboard that has less drag can do so more easily and for a longer period of time before exhaustion.

Surfboards typically cannot catch waves by lying idle in the surf. Rather, the surfer at the lineup must await the approach of a suitable wave, then turn to the wave's direction of travel, and quickly accelerate by paddling to an appropriate velocity to catch the coming wave. Surfboards that have less drag will catch more waves more easily because the surfer can expend less energy to accelerate the board to wave-catching velocity, or can accelerate more quickly. Paddling, wave-catching and maneuverability also are better on surfboards with less drag. Surfboard acceleration is this inversely related to the surfboard's drag.

Drag is a function of the surfboard's shape, surface area, attitude in the water, and shape, as well as a function of the design of the surfboard fins. Minimizing surfboard drag and surfboard-fin drag is particularly important because unlike other ski or board sports, after surfers have successfully ridden a wave, they must propel themselves by paddling back through the surf, or back to the lineup to catch another wave, which is increasingly tiresome or exhausting with increasing drag. In order to catch waves, drag is likewise important to keep that a minimum so that surfers may paddle quickly to catch the wave, something that is increasingly difficult to do with increasing drag. Decreased drag thus enables surfers to surf longer and to catch more waves.

Turning of a surfboard involves a complex interaction between a surfer adjusting the roll angle of the board, by adjusting the pitch of the board, and by surfboard and surfboard-fin design. Generally speaking, surfboards having more rocker, the curved shape of a banana with surfboard tip and tail elevated from the horizontal, have a natural tendency when placed on edge to turn consistent with the rocker shape. But increased rocker also increases drag, compromising speed, compromising the ability to accelerate to catch waves, and increasing the difficulty of paddling the surfboard. Surfboard edges, or rails, can be anything from circular or rounded in shape, known as soft rails, to flat or hard rails in which the flat surfboard bottom turns sharply upwardly to meet the surfboard's top deck. Surfboards with hard edges tend to turn more quickly or more sharply than those with softer rails. Surfboards, as opposed to surfboard fins, have undergone a significant and largely empirical design evolution applying these concepts since the beginning of the modern sport in approximately the 1950s and 1960s.

But surfboard-fin design has evolved relatively little over the past several decades of the modern sport of surfing. Surfboard fins assist turning of a surfboard much as rudders and ailerons help boats or airplanes turn or maneuver, by providing largely lateral resistance and lift, with some vertical lift component depending on the orientation to the vertical of the fin in the water. Without fins, a surfboard in a turning maneuver would tend to spin out, whereas with one or more fins, a surfboard rider can use his or her weight to control the yaw angle of the fin while riding a wave, and can use the attached fin or fins as a lever against which to turn the board. As in surfboard design, minimizing drag in designing fins is an important objective because doing so increases speed, increases acceleration capabilities, and minimizes necessary paddling effort.

But minimizing drag of the fins is not enough; else the fins could of course be infinitesimally small to the point of nonexistence. To the contrary, surfboard-fin design must minimize drag while maximizing lift, because lift is the force that makes the surfboard turn, just as the force of lift allows sailboats to sail toward the wind, airplanes to fly, and both to turn. Thus a more efficient, higher-lift fin can be smaller in size, with less surface area, and thus with less drag than a less-efficient fin that has more surface area and more drag.

Surfboard fins available on the market today, and for which patent applications have in the past been made or granted almost uniformly ignore important hydrodynamics principles, or applicable aerodynamics principles.

Hydrodynamics teaches that interference drag is caused by the intersection of a watercraft the hull and appended to such as a keel. Designers have attempted to minimize interference drag by shortening the length of the keel-to-hull intersection by means of a cut away at the trailing edge of the keel. Although helpful, the cut away trailing edge tends to be less effective at reducing interference drag than a forwardly upwardly protecting root after leading edge.

Hydrodynamics and aerodynamics teach that lower sweepback angle increases lift while decreasing drag for a given surface area. But foil selection is critical because lower sweepback-angle fins are more prone to stalling than higher sweepback-angle fins. Greater sweepback angle on a fin that is being turned places the entire planform obliquely to the turning direction and functions more as a brake than a higher-aspect ratio fin.

Hydrodynamics and aerodynamics teach that higher-aspect ratio planforms generate more lift with less drag than lower aspect ratios. Aspect ratios of 2:1 or more are preferred over lower aspect ratios.

Hydrodynamics teaches that underwater foils should not be too thin, or cavitation will occur. Underwater foils should be between 9 percent and a 15 percent thickness.

Hydrodynamics teaches that fins used as rudders should not be too thin, and that a certain foil sections maintain laminar flow necessary to produce lift with a minimum drag over a wide variety of angles of attack as contrasted with other types of foil sections. NACA 0010 and 0012 foil sections have a demonstrated history of effectiveness. Maximum foil width should be no greater than 35% aft of the leading edge, and point of maximum width 30 half of the leading edge is demonstrated as being particularly desirable for rudders as in NACA 0010 and 0012 series foils.

Hydrodynamics teaches that the end of fins should have the same shape as the cross-section of the foil shape within the fin itself.

Hydrodynamics teaches that foils should not have a great taper ratio and that the tip chord length should be between 40 and 60 percent of the root chord length.

Aerodynamics and hydrodynamics teach that endplates, fences, wings, or winglets placed at the end of wings, keels, or other hydrofoils can be effective at reducing the loss of lift that occurs at the end of such surfaces due to downwash and tip-vortex drag. But if improperly designed, used, or placed, such devices will increase surface area to such an extent that overall drag is increased, and there is no net benefit demonstrated by the use of such endplates, fences, wings, or winglets.

Aerodynamics and hydrodynamics teach that winglets, as opposed to endplates, fences, or wings, have proven effective at reducing induced drag while increasing lift in greater proportion than the increased area and associated additional form drag of the winglet, and thus greater lift with less drag than an equivalent increase in planform area or span length. Winglets have a shorter chord length than the wing tips to which the winglets are attached, as distinguished from endplates, fences, or wings. Winglets should themselves be effective lifting surfaces, and should be designed with the aerodynamic and hydrodynamics principles discussed above.

Aerodynamics and hydrodynamics teach that elliptical wings or fins yields tip vortices that are less concentrated at the tips, the downwash is spread more evenly across the wingspan. Here, the term "elliptical" does not necessarily refer to the shape of the planform, which planforms generally do exhibit elliptical lift, but to the distribution of lift across the planform. Rectangular wings or fins can yield a close approximation to elliptical lift distribution.

Aerodynamics and hydrodynamics teach that winglets themselves can benefit from winglets, which when attached to winglets on a wing or fin, result in a C-shaped wing or fin shape to the wing or fin to which the winglets are applied when viewed from the leading or trailing edges of the wing or fin assembly. Overall wing or fin lift is increased with such a C-shaped wing or fin assembly.

Existing surfboard fins typically do not incorporate the aerodynamic and hydrodynamic principles discussed above. For example, surfboard fins typically are heavily raked or swept back from the vertical, often to the point where the leading edge of the surfboard fin is approximately 35 degrees to the perpendicular to the fin root chord. This condition encourages downwash, the situation in which water flowing horizontally past the fin moves from one side of the fin to the other, then creates a large vortex behind the fin as it travels though the water. Moreover, the high-sweepback angle contributes to the loss of the laminar flow of water past the fin, such that the water on the back half of the fin is turbulent as opposed to smoothly flowing, and thus such fins stall earlier and lose lift and turning ability at a shallower angle of attack than a fin of low sweepback angle. Turbulent conditions as encountered with typical surfboard fins should be avoided in order to minimize drag while maximizing lift.

Surfboard fins typically have no recognizable hydrodynamic section or foil shape; they appear to not be designed or engineered other than to look good, and they look like one another. Indeed, many surfboard fins are nearly flat in section, particularly when used as side fins. When a surfboard with such flat-sectioned fins turn or yaw such that the angle of attack between fin and moving water no longer is straight ahead, or a zero angle of attack, many surfboard fins quickly stall. Stalling is the critical loss of foil lift, the angle of attack at which fins cease functioning as fins, and begin working only as brakes, creating drag but no lift. In airplanes, the airplane dropping from the sky illustrates wing stalling, whereas in surfing, fin stalling generally results in the board slowing or stopping, and in losing the wave, which continues uninterrupted. Consequently, a shortcoming of existing surfboard-fin design is that they are typically too flat in section, and are not engineered to incorporate low-drag foil sections that produce lift with minimum drag over wide range of yaw angles.

Surfboards today commonly have one, two, three, or four fins, but combinations of one fin and three fins are most common. When in combinations of more than one fin, the side fins typically are arranged near to the edges, or rails of the board. Side fins typically today are toed-in, arranged not parallel to the longitudinal axis of the surfboard, but rather with their leading edges pointed inwardly by a few degrees. Although this arrangement assists the turning of the board when only one such fin is immersed, when two such toed-in fins are immersed, they act together as a brake, increasing drag, because one wants to turn left, while the other right. Toed-in side fins is simply an effort to work around, accommodate, or to resolve existing fins' inability to create lift over a wide range of yaw angles without stalling, or to accommodate flat-sided side fins, but in the process, the typical arrangement of side fins increases drag and promotes stalling as compared to a non-toed-in arrangement of side fins. Moreover, the toed-in arrangement of side fins inhibits paddling and acceleration, causing earlier surfer exhaustion, and inhibiting acceleration and thus wave-catching ability.

With some exceptions, surfboard fins generally have a much longer chord length at their base, the fin root, than they have at their tips, thus a high taper ratio, and typically fins have a short span, and a low aspect ratio. Although this design combination assists with strengthening the fin, it aggravates drag. Hydrodynamics principles teach that underwater appendages such as keels and rudders, or analogously, surfboard fins, should have high aspect ratios and comparatively short root lengths and taper rations between 0.4 and 0.6 in order to maximize lift while minimizing drag.

Some surfboard fins, as in some old sailboat keel designs, decrease the fin root length by means of a cutaway or a scallop where the fin meets the board at the fin's trailing edge. But hydrodynamic principles teach that a cutaway at the trailing edge, while helpful to decreasing drag, is less effective at minimizing drag than a forward-projecting, foil-shaped blended keel or fin section, much like bulbs on the bows of freighters and the other ocean-going ships actually decrease drag by projecting forward of the ship's hull.

Aerodynamics and hydrodynamics principles teach that an endplate, wing or winglet, a surface oriented generally perpendicular to the fin and parallel to the path of water travel past the fin, decreases or prevents drag-inducing and lift-decreasing downwash. Downwash is the tendency of a fluid on the high-pressure side of a wing, keel, or fin to move to the low pressure side, in a circular motion. Plates or wings are effective at preventing that movement from one side of the wing, keel, or fin, but at a penalty—the plate or wing adds surface area to the wing, keel or fin. Hydrodynamics studies and experiments, however, teach that winglets—small wings with chords significantly shorter than the fin chord itself and with significantly smaller areas that the wing, keel or fin to which attached—produce the same or similar downwash-canceling effects as wings, but with a much smaller surface area, and thus with a much smaller drag penalty. Thus the incorporation of winglets, as opposed to wings, increases lift while decreasing drag.

Moreover, winglets assist in maintaining lateral lift that otherwise would be lost when a surfer rolls the board to one side in a turning maneuver thus placing the surfboard fin at an angle to the vertical, shortening the vertical length, and creating a tendency of the fin to pop out of the water, losing all turning control of the fin. To be effective and to avoid increasing drag, the winglets themselves must be effective lift-producing surfaces, must be correctly sized and placed or they risk increasing drag by virtue of their added surface area. Increasing lift with low drag increases wing, keel, and fin efficiency and speed.

Hydrodynamics teaches that a rounded nose section, as exists with NACA 0010 and 0012 foil sections, is better for rudder design because such rounded nose sections facilitate lift production over a wide range of yaw angles. Existing fin design typically are sharp or angular at the nose. In addition to decreasing the effective useful range of fin before stalling, the design is dangerous when it strikes surfers, because of the sharp surfaces, especially the tip.

Surfers, especially those who surf longer surfboards or surfboard called longboards, often attempt to noseride, a stance on the board forward of the board's midsection, as shown in FIG. 11. Surfboards are prone to nosediving when a surfer is surfing a surfboard from that location.

The following definition list is helpful to an understanding of this disclosure.

| Term | Definition |
|---|---|
| Angle of attack | The angle between the direction of fin movement through the water and the fin's chord line. |
| Aspect ratio | Aspect ratio is a measure of how long and slender a fin is from fin root to tip. The aspect ratio of the fin is defined as the square of the span divided by the fin area. Typically high-aspect-ratio fins have long spans and aspect ratios of 2:1 or greater, while low-aspect-ratio fins have short spans and lower aspect ratios. Higher aspect-ratio fins have lower drag and higher lift than lower aspect-ratio fins. |
| Boundary layer | The layer of water molecules near the surface of the fin whose velocities are changed that by movement of the fin through the water. Boundary layer flow may be either laminar or turbulent. |
| Chord | The distance between the leading edge of the fin and the fin's trailing edge. |
| Chord line | The line between the fin's leading and trailing edges. |
| Downwash | A fin with an angle of attack other than zero creates lift and has a difference in water pressure on the two sides of the fin. Near the fin tip, water is free to move from the region of high pressure to the region of low pressure, creating a circular water flow from one side to the other, which creates a vortex or helix because of the fin's movement through the water. Larger circular flows result in larger vortices, greater drag, and lift. The presence of winglets at or near the tip of the fin inhibits this circular flow, reduces vortex size, decreases drag and increases lift. |
| Drag | Drag is the hydrodynamic force that opposes any watercraft's motion through the water, and is a vector quantity along and opposed to the watercraft's path of travel through the water. Drag is directly proportional to the area of the fin, and also is affected by fin shape, foil shape, fin thickness, and fin aspect ratio. |
| Fin root | That portion of the fin that constitutes the base of the fin when the fin is within the fin box, the lowest exposed portion of the fin when in use. |
| Fin base | The portion of the fin intended to fit snugly with a fin box to limit unintended movement, while providing a means of adjustability in the longitudinal direction. |
| Fin box | The channel within into which the fin base is placed, typically with a channel that allows longitudinal adjustment, while restricting side-to-side movement. The fin box is not claimed as an invention in this disclosure. |
| Foil | The cross-sectional profile shape of the fin. |

-continued

| Term | Definition |
|---|---|
| Laminar flow | Layered or smooth-flowing water within the boundary layer, as opposed to turbulent or disordered flow within the boundary layer. |
| Lift | The vector-quantity force created by the movement or turning of water past a curved fin surface, which force acts perpendicular to the direction of water flow. Lift is directly proportional to the area of the fin. |
| Lineup | The spot outside the area of breaking surf at which surfers await waves to ride. The takeoff zone from which surfers must quickly accelerate from a standstill to a sufficient velocity in order to catch the approaching wave. |
| NACA | The National Advisory Committee on Aeronautics, the predecessor to NASA. NACA performed extensive testing on airfoil shapes to determine the lift and drag characteristics of various foil shapes. |
| Pitch | Pitch is the angle of deviation from the horizontal of the surfboard's or other watersports board's longitudinal axis-e.g, the nose of the board or watercraft is pointed somewhat upwardly or downwardly, as in airplanes when they take off and climb or descend. |
| Planform | The planar shape of the wing or foil, which for wings is typically the outline of the horizontal plane, and for rudders and fins, the outline of the vertical plane. |
| Roll | Roll is the angle of deviation from the horizontal of the surfboard's or other watersports board's side-to-side axis-e.g. the board is leaning somewhat on its right or on its left edge, as in airplanes when they bank their turns. |
| Stall | Loss of lift, as demonstrated by the turbulent flow of water past the fin. Differently shaped foils have different points or angles of attack at which they stall. A stalled fin moving through the water loses lift, but increases drag, thus acting as a brake. |
| Sweepback | The angle by which the one-quarter-chord line of the foil sections within the planform deviates from the perpendicular to the root chord. Some authorities refer to leading edge sweepback angle, which as the name implies refers to the angle away from the root chord perpendicular of the wing or fin's leading edge. |
| Water sports board | A watercraft primarily used by a single rider, propelled by gravity, waves, wind or by towing, such as a surfboard, a kite-surfing board, a sailboard or windsurfer, a waterski, or a wakeboard. |
| Winglet | A planar, foil-sectioned projection substantially perpendicular to the fin plane, generally placed at or near a fin tip or wingtip to reduce tip vortices and consequent downwash and drag. |
| Yaw | The angle of deviation from straight forward in the path of travel to an orientation other than straight, a spinning about the vertical axis, as in airplanes landing in a strong crosswind that "crab" their way to a safe landing. Rudders that steer move though an angle of yaw, as do fins on a turning surfboard. |

DESCRIPTION OF RELATED ART

Cutaways have been observed in prior art available on the market, but no fins with a forwardly displaced root section that creates both a forwardly upwardly slanted fin leading edge in conjunction with a cutaway at the trailing edge have been observed.

Endplates or fences as well as wings and winglets have been studied and tested in aerodynamic applications such as with aircraft and missiles and, to a lesser extent, in hydrodynamic applications, such as with hydrofoil craft. But of the use of planar winglets, as opposed to endplates, fences, or wings to increase lift while decreasing drag by reducing tip-vortex generation has not been observed in prior art. No applications of C-shaped fins have been observed.

High aspect ratio foils of low sweepback angle have been observed on the market for windsurfers' daggerboards, but not for steering fins, and the daggerboards observed are of thin foil sections, not of foil sections intended to produce lift over a wide range of yaw angles, nor have any been observed to have winglets.

An approach with similarly of structure but difference in function was shown in U.S. Pat. No. 4,050,397, the primary objectives of which were to increase the lift and decrease the drag of foils on hydrofoil craft, watercraft designed to be lifted partially or totally out of the water by such foils. Vertically arranged end plates or wings were incorporated into that invention so as to span the entire chord length of the horizontal foil to which attached or were designed to be attached to an articulating portion of such a foil in order to maximize lift vertically. The surface area of the endplates was excessively large and increased drag as contrasted with the current disclosure, and were not designed so as to assist turning.

A rudder incorporating a tip-vortex suppression means designed to be placed immediately behind a propulsion device was observed in U.S. Pat. No. 6,101,963. The tab or endplate in that invention was designed to minimize adverse effects associated with three types of cavitation that occur as a consequence of the circular flow from propulsion devices that are placed immediately in front of rudders. That invention incorporated an endplate or tab with a chord length greater than the chord length of the tip of the rudder to which the endplate was attached. The surface area of the endplate was excessively large and increased drag as contrasted with the current disclosure.

A vortex dissipater comprised of a fixed flat-sectioned plate secured at the tip of an airfoil or hydrofoil extending from the trailing forward between 0.3 and 0.6 times the chord tip length was disclosed in U.S. Pat. No. 3,845,918. The flat endplate in that disclosure suffers from inability to maintain lift over a wide range of angles of attack as contrasted with the current invention, which incorporates a foil-shaped, lift-generating winglet projecting from the trailing edge of the hydrofoil forward to 0.7 times the chord length in the preferred embodiment.

Keels incorporating wings have been developed for sailboats, notably the design of Ben Lexcen used in the America's Cup in 1983, as well as for water skis and for windsurfers, as disclosed in U.S. Pat. Nos. 6,234,856, and 5,809,926. Ben Lexcen's keel design was primarily to achieve stability through the righting moment of ballast that has a low center a gravity, while having a shorter keel-root length to decrease drag, and also while maintaining the required lift though the use of wings. Sailboat keel designs typically serve the functions of providing lift to assist forward drive while minimizing sideslip or leeway, and also of providing ballast to resist the heeling force of wind on the sails. In contrast, the current disclosure is not intended to provide righting ability through ballast.

Somewhat related prior art consists of hydrofoils, which have been incorporated into boats and other water riding apparatus. In U.S. Pat. Nos. 6,234,856, and 5,809,926 the technology is primarily concerned with lifting a rider and craft out of the water, by means of the operator being propelled by towing, or by the wind. Both systems require vast quantities of power to make the system work, and have drag that would preclude their use in surfing because of the drag and thus the resistance to paddling and wave catching, as contrasted with the current disclosure. The current disclosure is not intended to lift the board or its rider out of the water.

Another United States patent, U.S. Pat. No. 3,747,138, discloses hydrofoils that are designed for use on both the nose and the tail of a surfboard, and are designed "having a sufficient area, angle of attack and lift to support at least a portion of the surfboard above the surface of the water" with horizontal hydrofoils on the lower extremities of struts. Thus that invention is related to means of providing enough lift in the vertical direction to facilitate hydroplaning action. U.S. Pat. No. 3,747,138 thus is designed to lift the board and its rider vertically and clear of the water, and to support the board and rider out of the water, solely by the hydrofoil. That invention has excessive drag, and inhibits paddling and wave catching ability, as contrasted with the current disclosure.

U.S. Pat. No. 4,320,546, claims a planing hull together with a centrally located horizontal wing element, the wing of which is of maximum width at the trailing edge of the wing. This prior art was intended to generate negative lift, i.e. vertically downward pressure at the tail end of the surfboard, in order to prevent what is known in surfing as pearling, otherwise known as nose diving. Low-aspect foil surfaces were used in that invention, and thus have high drag relative to the fin's lift, and drag greater than that in the current disclosure, which incorporates planforms of high aspect ratios to minimize drag while maximizing lift. Additionally, U.S. Pat. No. 4,320,546 provides no means of preventing vortices from occurring at the bottom tip of the fin, and thus no end plate, fence, wing, or winglet at or near the fin tip to reduce downwash and associated drag, in contrast to the current invention. U.S. Pat. No. 4,320,546 does not disclose a foil section designed to promote laminar flow over a wide range of yaw angles, and thus will not function to promote turning over a wide range of yaw angles, as does the current disclosure.

An application for a patent, U.S. Ser. No. 814477, abandoned, and published as U.S. patent application Publication 2002/0094733, was intended to assist the maneuverability of a surfboard not only in water, but also when airborne, by means of a horizontally arranged, flat-bottomed, dolphin-fin shaped wing that has a width greater than the vertical length of the vertical fin. The current invention, by contrast, is not intended to assist aerodynamics, or lifting or turning of the board while in the air. The current invention's winglets are small in comparison to the vertical fin, and are not intended by themselves or in conjunction with the vertical fin to provide lift while airborne. The Dolphin-Fin design of Ser. No. 814477, abandoned, appears at page four of five to incorporate an asymmetrical wing foil section, and is thus intended to produce lift in only one direction, upwardly like an airplane wing, in contrast to the current invention, which has a symmetrical winglet foil section, and is intended to produce lift upwardly or downwardly, depending on the surfer's movements, and the angle of attack of the winglets, to assist maneuverability in three dimensions.

A related design now on the market, but apparently not the subject of a U.S. or Australian patent, is a design manufactured by "FCS," or Fin Control Systems, under the trade name FCS 3D, or FCS 3d Red Tip. That design incorporates a fin of low aspect ratio and high sweepback angle with a low-aspect-ratio planform, full-chord, wing, which wing itself is nonplanar, but is curved from wing root to wing tip. The low-aspect-ratio planform, high-sweepback, nonplanar, full-chord wings all are features that have less lift and greater drag than the current invention, which incorporates a high-aspect-ratio planform, with a high-lift, low drag foil section effective over a wide range of angles of attack, with foil-shaped planar winglets of a chord length 0.7 times the tip chord length in the preferred embodiment.

A further surfboard fin design, U.S. Pat. No. 6,106,346, marketed under the trade name "Turbo Tunnel," is designed to enhance noseriding a surfboard, or the riding the board near to its tip, by means of a venturi tube in the middle of the fin's span. The cylindrical venturi tube produces lift 360 degrees outwardly and perpendicularly to the to the direction of travel. The lift from one side of the tube thus cancels the lift on its opposite side, producing drag. Moreover, the fin disclosed in U.S. Pat. No. 6,106,346 is of traditional planform, and thus has a relatively high sweepback angle, a large keel root, no cutaway trailing edge, a low aspect ratio planform, and no means of preventing or of reducing downwash or vortices from the fin tip, in contrast to the current invention.

BRIEF SUMMARY AND OBJECTIVES OF THE INVENTION

The invention is comprised of a surfboard or other watercraft fin that can be used on the tail section of a surfboard or on other watercraft, specifically designed to increase lift while decreasing drag in order to increase maneuverability by turning and by accelerating, which also promotes wave-catching ability, and allows surfers to surf for longer periods of time before exhaustion by decreasing resistance to paddling effort.

The invention has an elongated, high-aspect-ratio, low sweepback angle planform vertical fin having a symmetrical, rounded-nose, high-lift-low-drag NACA 0010, 0012 series foil, or other foil section that similarly maximizes lift throughout a broad range of angles of attack, and that maintains laminar flow around the foil while minimizing drag. The purpose of these design features is to maintain laminar flow over a wide range of angles of attack, thus avoiding the drag associated with stalling.

The vertical fin has a forward-projecting fin root section that results in a forward projecting leading edge and a cutaway at the trailing edge, which features decrease interference drag at the intersection of the fin and the surfboard or watercraft.

The vertical fin has an elliptical shape or a rectangular planform that develops or closely approximates an elliptical lift pattern. The purpose of such design features is to minimize induced drag caused by tip-vortex downwash.

The preferred embodiment has attached to the vertical surfboard fin at or near its tip, as further detailed below, either a pair of perpendicularly arranged winglets, or a pair of winglets angled downwardly outwardly, also of symmetrical high-lift low drag NACA 0010, 0012, or other high-lift, low drag foil section, and of high-lift, low drag planform that minimizes stalling over a wide range of angles of attack, extending bilaterally from the widest point of the vertical fin's foil section toward the trailing edge, also with forward projecting fin root at the intersection with the vertical fin, and a cutaway at the trailing edge. In the preferred embodiment, this is intended to reduce tip-vortex induced drag.

For fins to be used as side fins, the invention as described properly has a winglet or a winglet array on one side only, projecting outward toward the edge of the surfboard, also intended to reduce tip-vortex drag, but also to promote lift disproportionately on the outside of such side fins to promote turning.

The surfboard or watercraft fin as disclosed in the preferred and alternative embodiments minimize drag by reducing the fin-to-hull fin root with the cutaway, by incorporating the forward-projecting fin-root section element, by using high lift, low drag, rounded-nose, symmetrical foil sections and be incorporating such features into an elliptical planform or rectangular shape approximately elliptical lift, either alone or in conjunction with planar, foil-sectioned winglets extending from the fin's trailing edge forward to the point of maximum foil section width. Fins without such features wing assembly are less efficient, produce less lift over a narrower range of angles of attack, have more drag, and are more difficult to maneuver, more difficult to paddle, more difficult to turn, and tend to stall, resulting in the loss of the wave being ridden.

The horizontal winglets, or those fins angled downwardly outwardly, will develop lift in the vertical direction, either downwardly or upwardly depending on the surfer's movement on the board. The greater the winglet lift in the vertically downward direction at the tail, the greater the resistance to nosediving as when a surfer moves forward on the board while noseriding. Greater lift can be achieved by this invention in alternative embobdiments with winglets of greater span size and thus area, and with an array including a greater number of winglets, including winglets placed mid-span. Thus in an alternative embodiment, the vertical fin incorporates more than one pair of winglets, with one pair placed at or near the fin tip to discourage tip-vortex generation, and the other pair placed center span at the trailing edge of the fin to discourage mid-span downwash, such winglets projecting forward from the trailing edge to the widest point of the foil.

Fins can be used alone or in conjunction with others, including an arrangement with side fins. The invention embodied as side fins are to be placed such that they are oriented parallel to the longitudinal axis of the board, without toe-in, in order to reduce drag, and with one or more winglets per fin side, at least one of which winglet is affixed at or near the tip of the fin. Unlike other side fins, many of which are flat sided and attempt to overcome stalling associated with lift limited to narrow yaw angles, attempt to overcome the problem by toeing-in the side fins. This arrangement increases drag throughout all ranges of movement while both fins are immersed, as each is attempting turn against the other. The existing toed-in-flat-side-fin arrangement is thus effective only in a very narrow range, and otherwise produces excessive drag, inhibiting speed, inhibiting the ability to catch waves, and causing more resistance to paddling, tiring the surfer earlier than would otherwise occur. This disclosure is intended to facilitate effective turning through effective fin design, obviating the need for toed-in fins, and the resulting drag they create.

DETAILED DESCRIPTION OF THE INVENTION AND PREFERRED EMBODIMENTS

Figure 1:
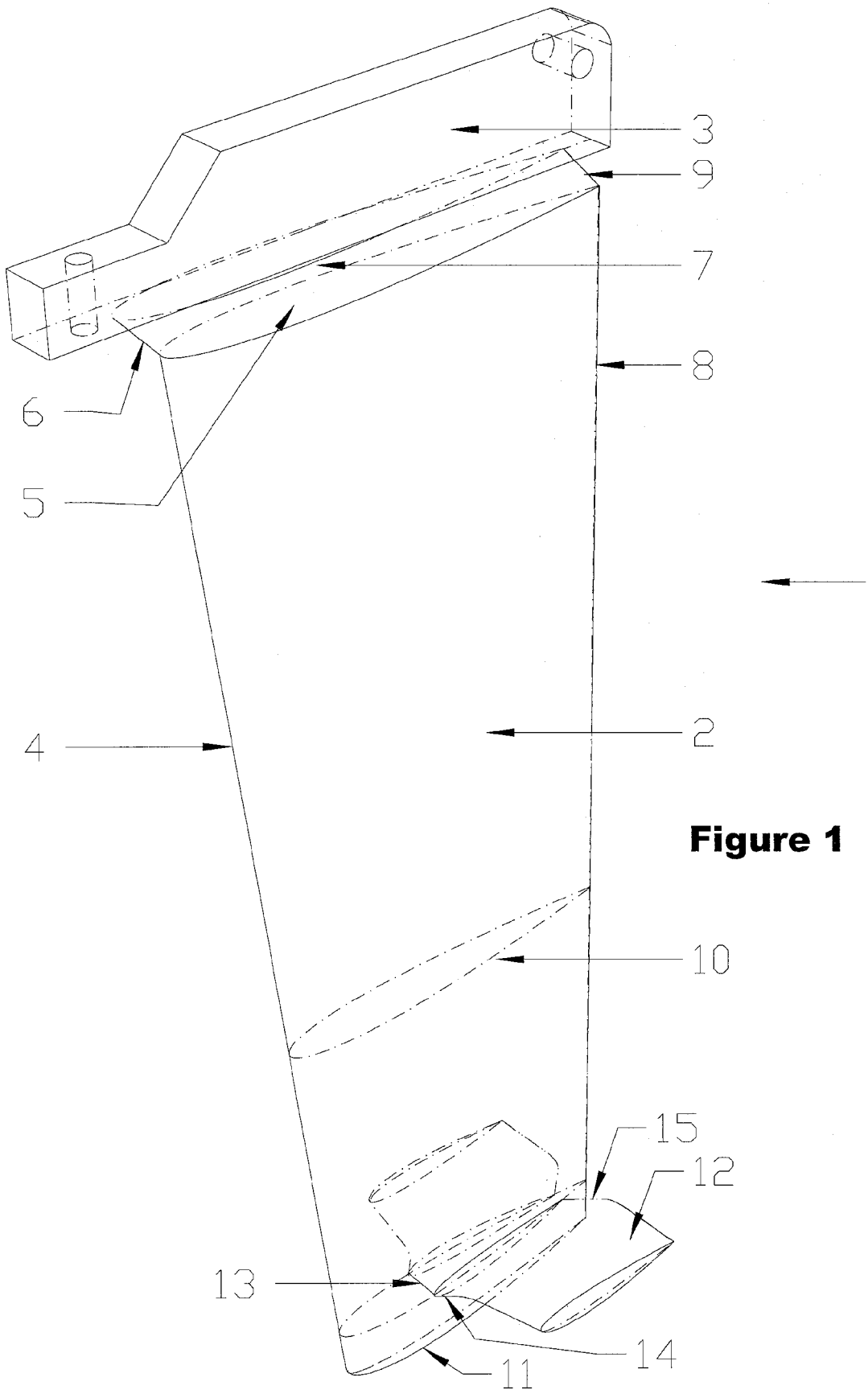
FIG. 1 is a perspective view of the present invention.

Referring now to the drawings and the characters of reference marked thereon, FIGS. 1 through 4 illustrate a first embodiment of the present invention. FIG. 1 is a perspective view of the invention 1, exhibiting a high-aspect-ratio planform 2 of 3:1 in this embodiment, which is connected to the fin base 3. The fin base 3 is designed to fit the fin 1 into common fin boxes available on the market and commonly used in surfboards and other watercraft.

Between the high-aspect-ratio planform 2 and the fin base 3 is a forwardly displaced section of the fin 5, which forward-shifted displacement creates both a forwardly upwardly sloped projection 6 between the leading edge 4 of the fin planform 2 and the fin root 7 and, at the upper end of the fin's trailing edge 8, a cutaway 9. Although cutaways have been employed alone in some designs available, the invention combines the trailing-edge cutaway feature and the forwardly projecting root leading edge to minimize interference drag, the drag caused by the proximity of the fin to the surfboard or watercraft surface.

The forwardly displaced fin section 5 is of a vertical dimension equal to the width of the fin at the fin root 7.

The high-aspect-ratio planform 2 in cross section 10 is a high-lift, low drag NACA 0012 foil section in this embodiment, which has maximum width at 30 percent of the chord length behind the fin's leading edge 4. The foil section 10 chosen for the first embodiment has width equal to 12 percent of the chord length. The NACA foil section chosen for this embodiment has rounded nose section. This particular NACA foils section is a foil section type demonstrated to exhibit high lift over a wide range of angles of attack without stalling, in contrast to other foil types and other foil thicknesses. This is significant in the sport of surfing and other water sports where the invention is used for steering, because high lift without stalling over a wide range of angles of attack facilitates turning, turning without the fin stalling. Stalling fins act as a brake, because the stalled fin has lost lift and has only drag.

Tip vortices are formed as a consequence of lift generation as water moves from the fin side of high pressure to the fin side of low pressure as the fin travels though the water. The planform 2 of this embodiment is of high aspect ratio, and of largely rectangular planform, closely approximately an elliptical pattern of lift to reduce induced drag caused by tip-vortex downwash. Near the fin tip 11, in this embodiment, are planar winglets 12, designed to reduce tip vortex generation and the consequent induced drag. The planar winglets 12 are displaced vertically upwardly from the fin tip 11 by three winglet-foil-section widths in the first embodiment, and are arranged perpendicularly to the plane formed by the leading edge 4 and the trailing edge 8 of the fin planform 2. Although placement of the planar winglet at the fin tip is most desirable for the greatest drag reduction and for the greatest lift production, in this first embodiment the winglets are vertically displaced upwardly away from the fin tip 11 so as to reduce fin damage as can occur when the fin tip and winglets strike the beach, rocks, or other objects while surfing or while riding the watercraft to which the fin is attached.

Still referring to FIG. 1, the winglet 12 extends from the fin's trailing edge 8 forwardly to the point of maximum foil width 13, which given the NACA 0012 foil section used in this embodiment, occurs at 30 percent of the chord length behind the leading edge. Like the forwardly displaced fin section 5, the winglet 12 has a forwardly displaced base resulting in a forward projection 14 at the winglet leading edge, and a cutaway 15 at the winglet trailing edge, where the winglet 12 intersects the fin 2. The horizontal dimension of the forwardly displaced area of the winglet is equal to the width of the winglet-foil root section, which is of a foil-section type identical to the fin section 10 in this first embodiment, although of proportionately smaller dimension. The winglet's proportionately small size distinguishes the invention from airfoils and hydrofoils that incorporate endplates, fences, and full-planform-tip-width wings, all of which can be effective at reducing vortex-tip drag, but all of which have a proportionately larger surface area than the winglets 12 of the current invention, and thus pay a greater penalty in drag than is gained through the use of such endplates, fences, or wings. Moreover, the foil-shaped section of the winglet 12 of the current invention is in contrast to those references that employ flat endplates, fences, or sections. Winglets create more lift than the addition of an equivalent area to the baseline fin.

Figure 2:
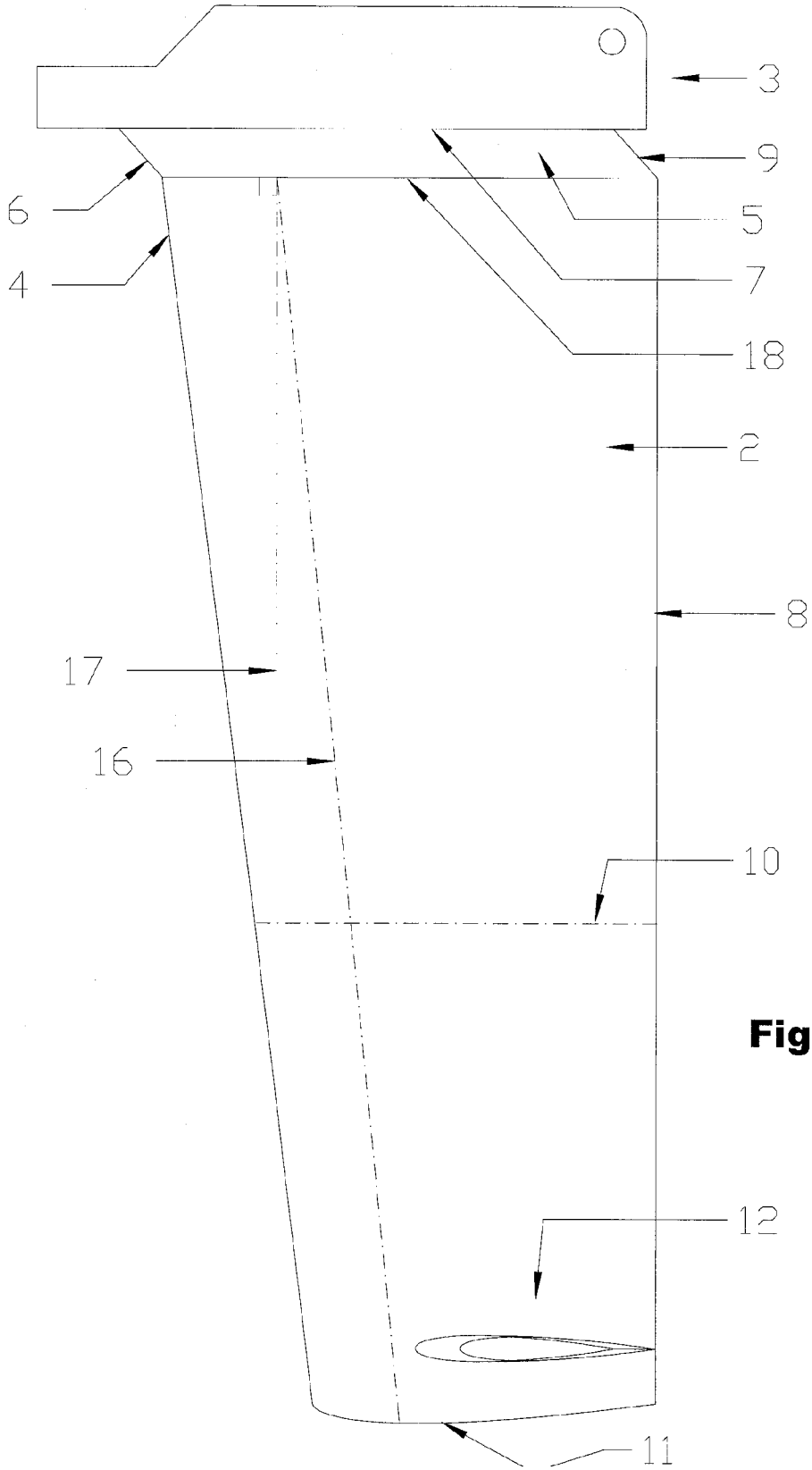
FIG. 2 is a side view of the present invention.

FIG. 2 is a side view of the invention, which demonstrates the winglet 12 placement vertically away from the fin tip 11, by three winglet-foil-section widths in this first embodiment, in order to protect the winglets from breakage during ground strikes, while reducing tip-vortex drag. FIG. 2 also shows the forwardly upwardly displaced fin section 5 between the fin root 7, and the planform root 18, along with the forward projection 6 of the leading edge 4 and cutaway 9 at the trailing edge 8 of the fin 2. The fin tip 11 has a contour from fin leading edge 4 to trailing edge 8 identical to the edge camber of the foil section 10, (better observed in figure 1), so it has a cross-sectional shape identical to the symmetrical foil shape divided along a line between the leading and trailing edges of the fin element. As can be seen in FIG. 2, the fin 1 , between the fin section 5 and the fin tip 11, has a substantially trapezoidal cross-section.

The fin 2 is of low sweepback angle 15, an angle of 5.6 degrees in this first embodiment. The sweepback angle is determined by measuring the angle between the fin's quarter-chord line 16 and the perpendicular 17 to the root 18. Low sweepback angles generate more lift per unit area because as the fin moves through the water, it strikes more water per unit of time and thus has more lift per square inch and per unit of parasitic drag than high-sweepback designs. Low sweepback angles are thus are more desirable than high-sweepback-angle fins.

Figure 3:
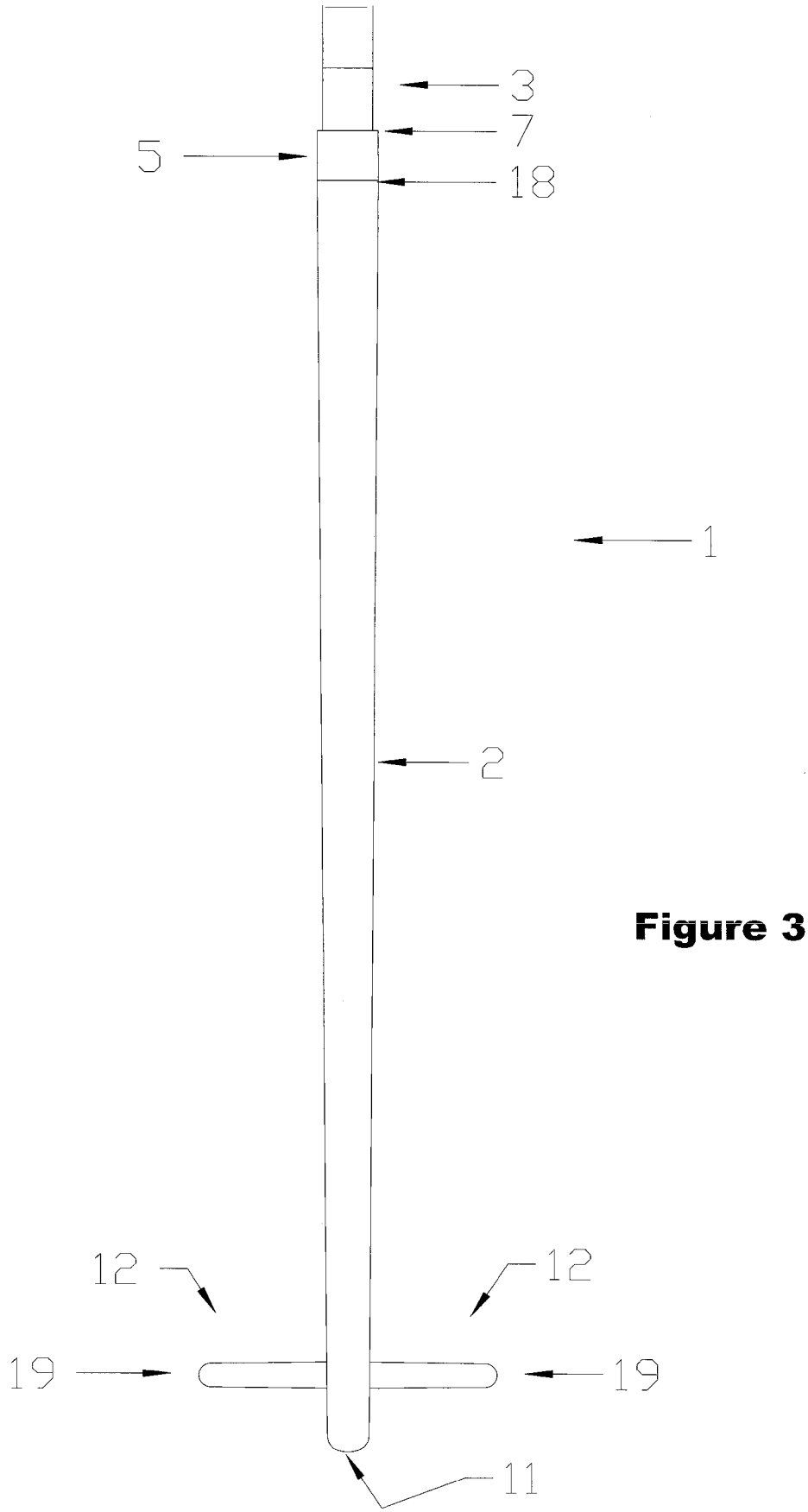
FIG. 3 is a front elevation of the present invention.

FIG. 3 is a front view of the first embodiment of the invention 1, showing in this view the rounded fin tip 11 when viewed from this angle. The rounding reduces drag as compared to other configurations. FIG. 3 also shows the diametrically-opposed arrangement of the winglets 12, which also have rounded tips 19 evident in this view. In this first embodiment of the invention, the planar wings are arranged perpendicularly to the fin 2.

Figure 4:
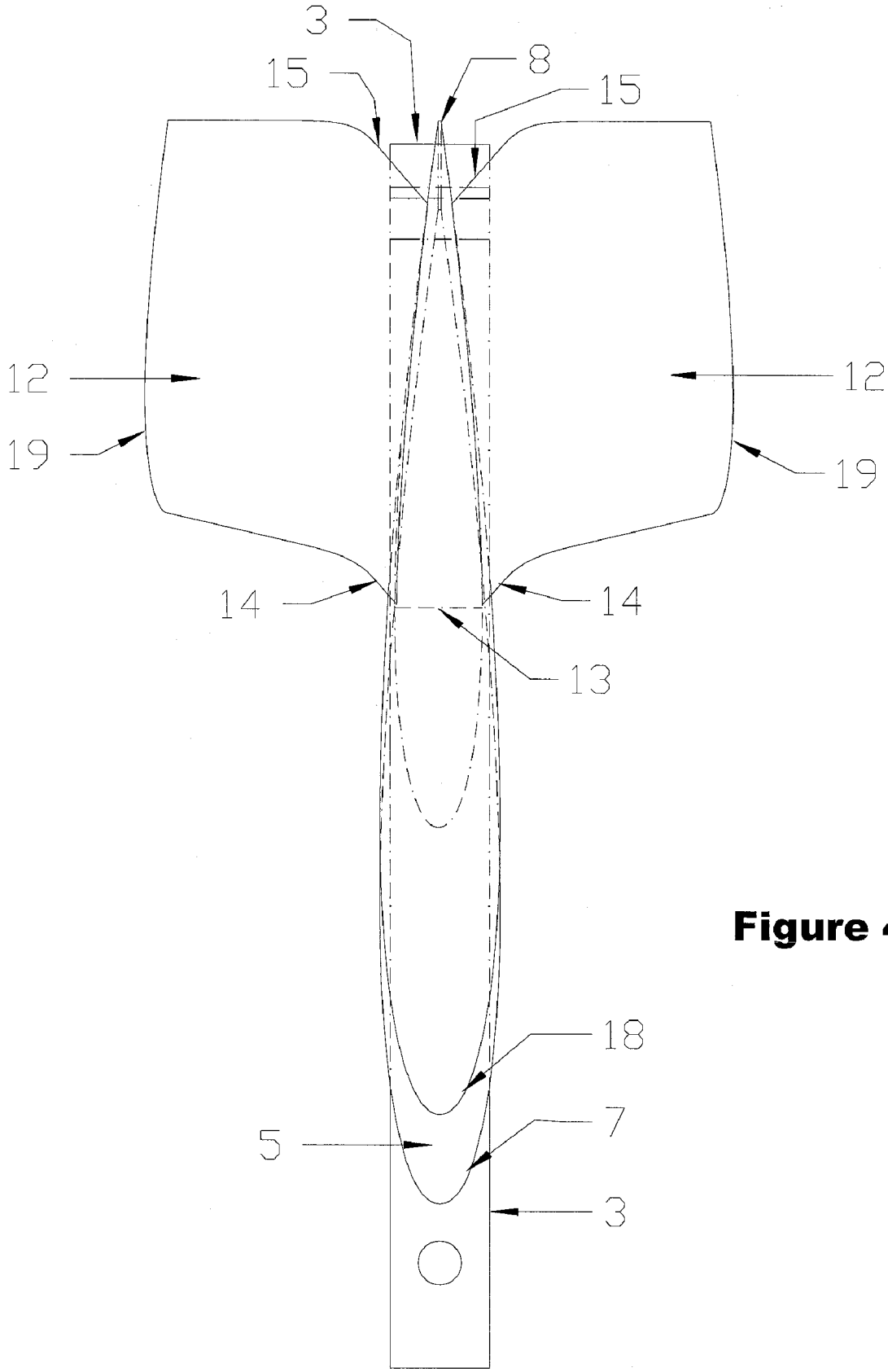
FIG. 4 is a bottom view of the present invention.

FIG. 4 is a bottom view of the first embodiment of the invention showing the fin base 3 with hole drilled to accommodate a screw, which devices are not part of the invention, but are shown for reference purposes. FIG. 4 shows the fin root 7, the forwardly displaced-projecting fin section 5, the fin planform root 18, the diametrically opposed winglets 12, which extend from the fin's trailing edge 8 forward to the point of maximum width of the fin foil section 13 where the winglets are attached to the vertical fin, with winglet tips 19 of a shape identical in form to the foil section of the winglet 12 (not shown) which is the same as but proportionately smaller than the foil section 10 of the fin 2 as depicted in FIG. 1. The forwardly displaced winglet bases 14 and cutaways 15 are shown.

Figure 5:
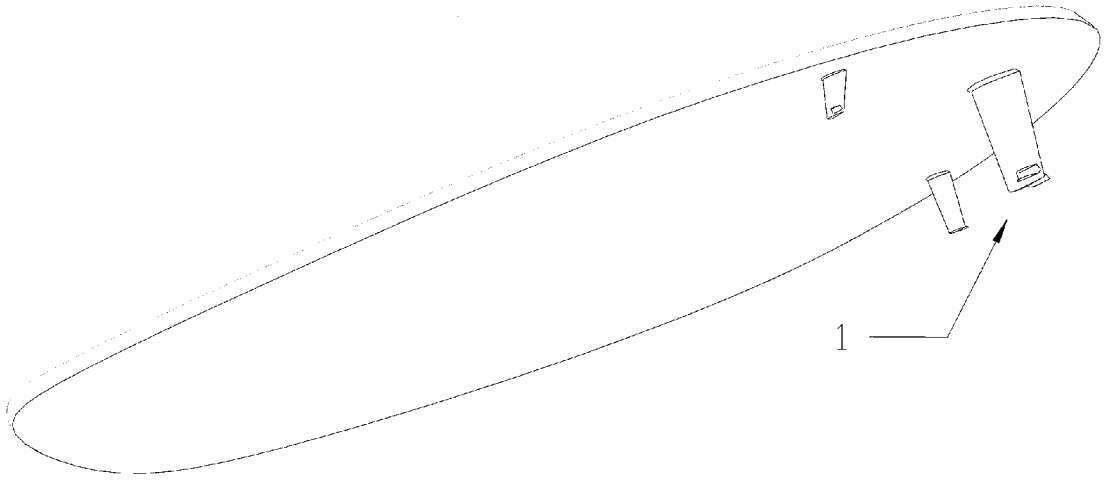
FIG. 5 is a perspective view of the invention as attached to the tail end of a surfboard, and as arranged with side fins, which side fins are an alternative embodiment of the invention.

FIG. 5 shows the bottom of a surfboard with an arrangement of three fins, comprised of one central fin and two side fins placed on the bottom of a surfboard, with the first embodiment of the invention 1.

Figure 6:
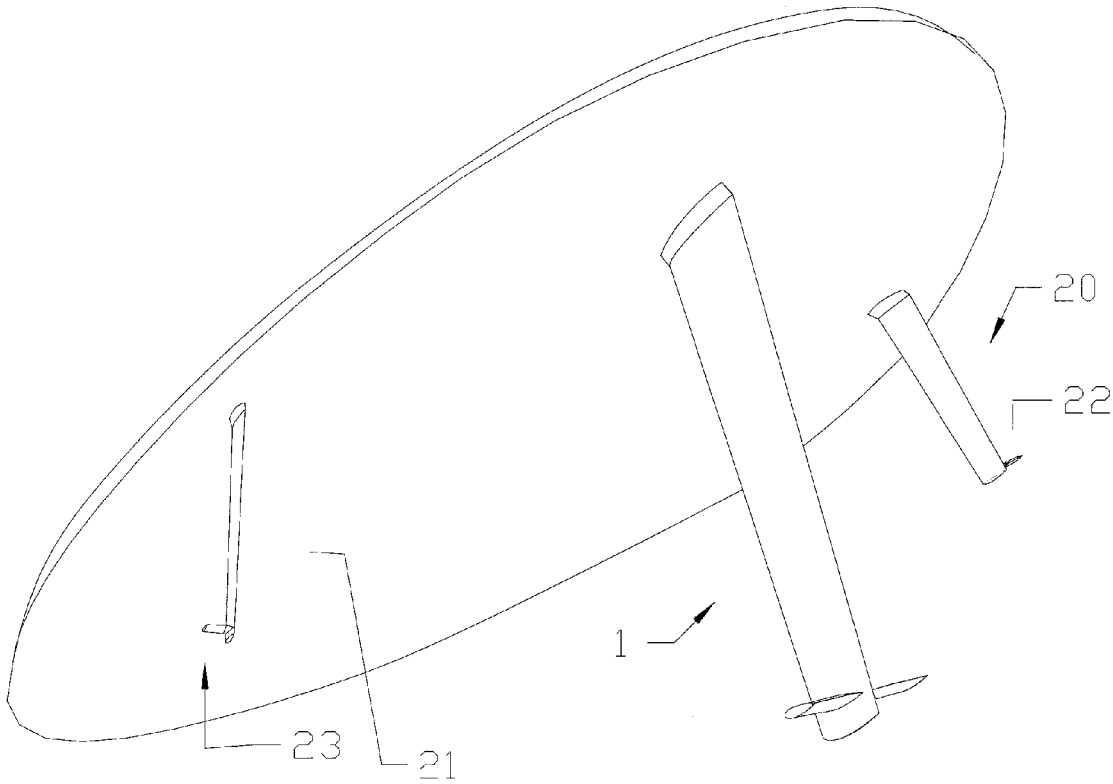
FIG. 6 is a close up perspective view of the present invention, together with side fins, which side fins are an alternative embodiment of the invention.

FIG. 6 shows a close-up view of the tail end of the surfboard that was depicted in FIG. 5, including the invention 1. Side fins 20 and 21 are shown, but are a second embodiment of the invention, because the side fins shown have only one winglet per fin, arranged so that the winglets are on the outside of the surfboard or other watercraft, to promote lift in that direction, and thus turning. As is common in surfboard design, the side fins are canted outwardly at their fin tips, because when placed on edge as when turning a surfboard, uncanted inside-of-the-turn fins without wings lose vertical depth, and with that loss of depth, lose both vertical surface area and lifting area perpendicular to the desired turn, thus losing turning effectiveness. The side fins 20 and 21 have the same configurations, components, and unique features as the invention 1, but for the removal of one winglet, but the side fins 20 and 21 are proportionately smaller. Configured and used as side fins, the invention is intended to not be toed-in as is common with side fins. Toeing in of side fins has evolved because the typically very thin, often asymmetrical side fins, often flat-sided predominately used today have a very narrow range of effectiveness, and thus lose lift quickly, and need to be angled to the expected turn path of travel to overcome that loss of lift. But surfboards are often not turning, as when gliding, when accelerating to catch waves, and when paddling back to the lineup. Toed-in fins at such times, and when turning beyond the effective narrow range of the typical flat-sided fin, are detrimental to surfboard performance as compared to the second embodiment of the invention, designed to be easier to paddle, quicker to accelerate, and able to perform over a wide range of angles of attack.

Figure 7:
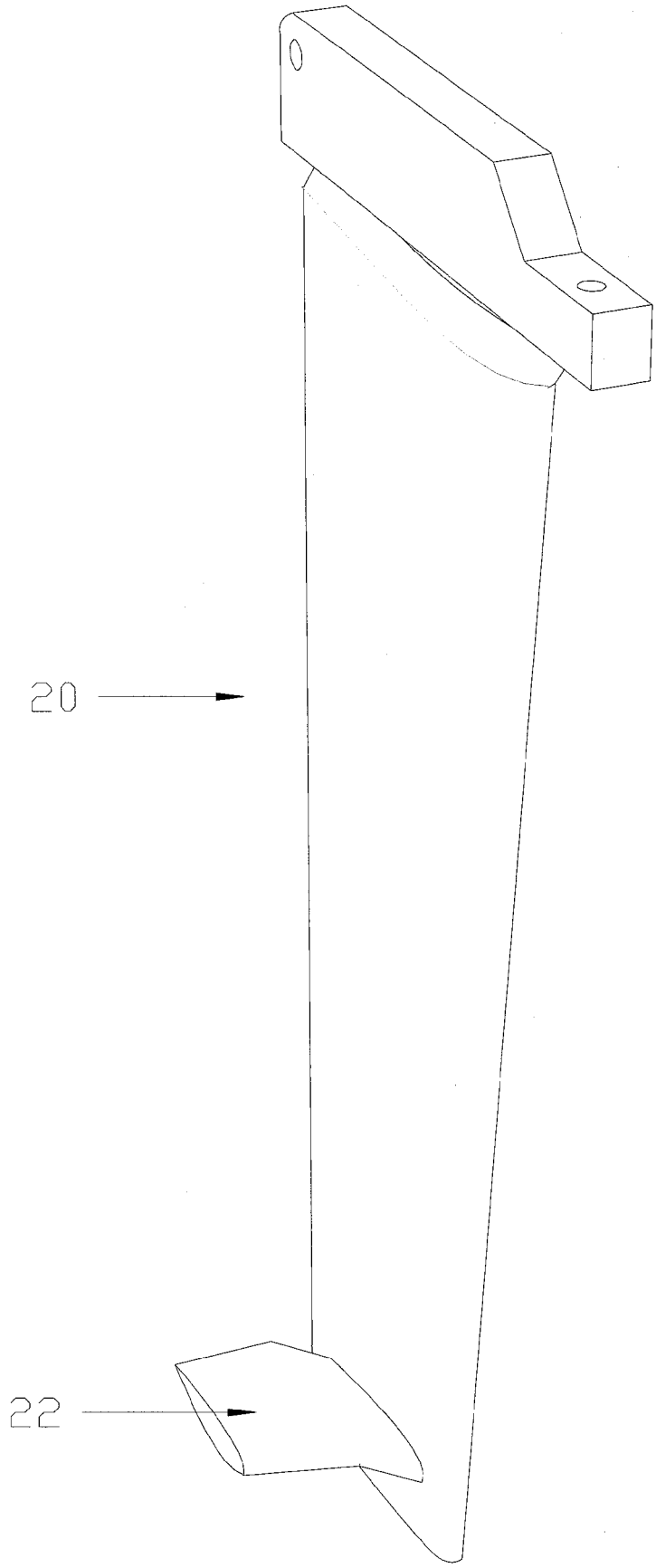
FIG. 7 is a perspective view of a different embodiment of the present invention, intended for use a side fin.

FIG. 7 shows a close-up perspective view of the right side fin 20, and its winglet 22.

Figure 8:
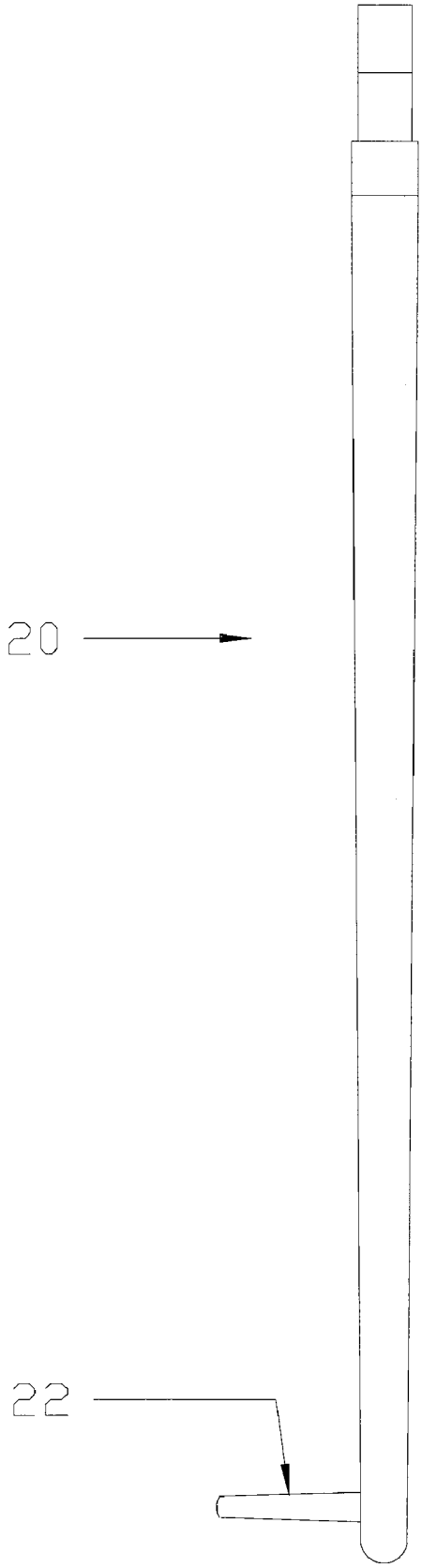
FIG. 8 is a front elevation view a perspective view of a different embodiment of the present invention, intended for use a side fin, as was shown in FIG. 7.

FIG. 8 is a front view of the invention in the second embodiment as a side fin 20 with a single planar winglet 22.

Figure 9:
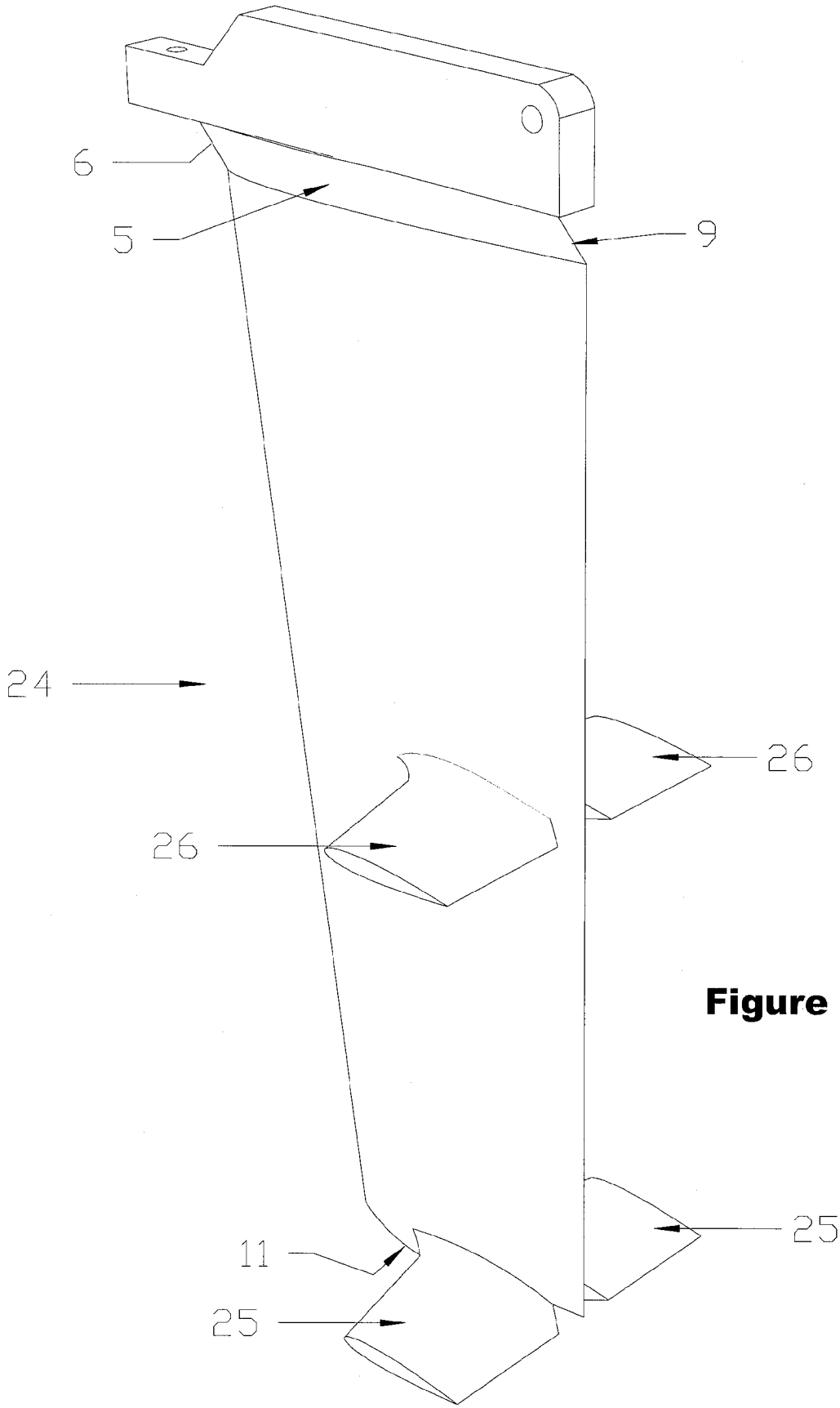
FIG. 9 is a perspective view of an alternative embodiment of the invention, with not only tip winglets directly at the fin tip, but also with mid-span winglets, all of which winglets are of larger span than the embodiment depicted in FIGS. 1-4, and thus greater vertical lift.
Figure 10:
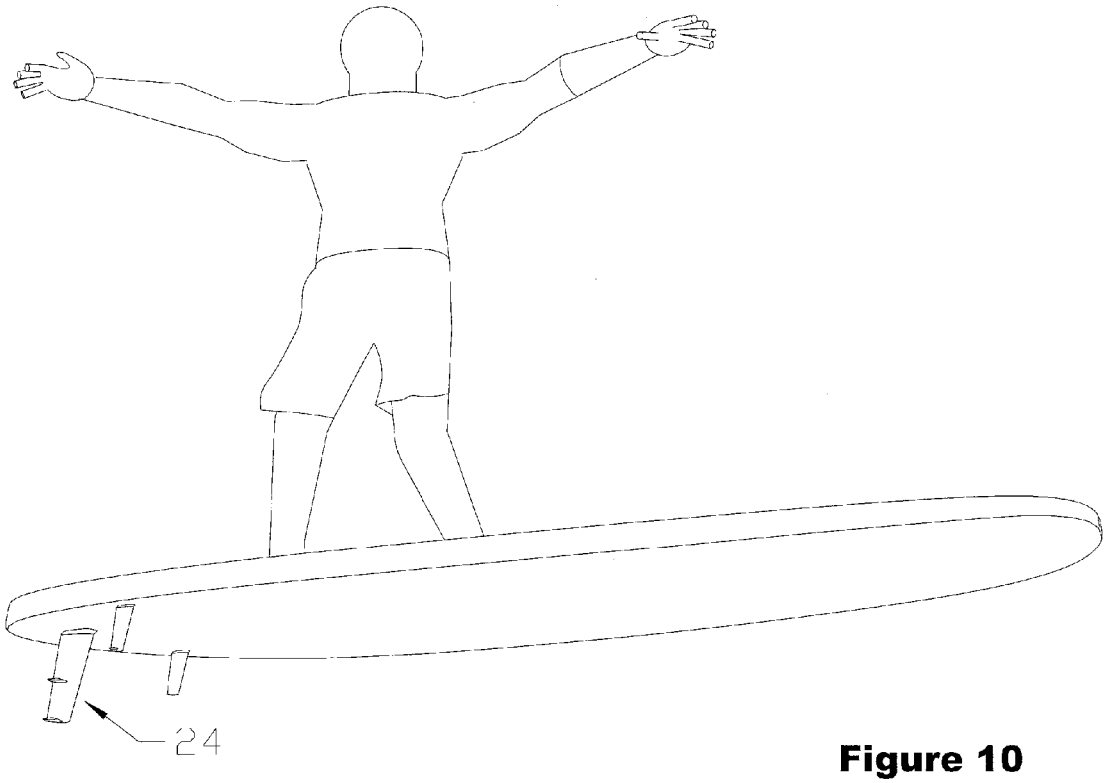
FIG. 10 is a perspective view both of a surfer on the surfboard in a position typical for general surfboard riding, and the alternative embodiment of the invention, arranged with side fins, also an alternative embodiment of the invention.
Figure 11:
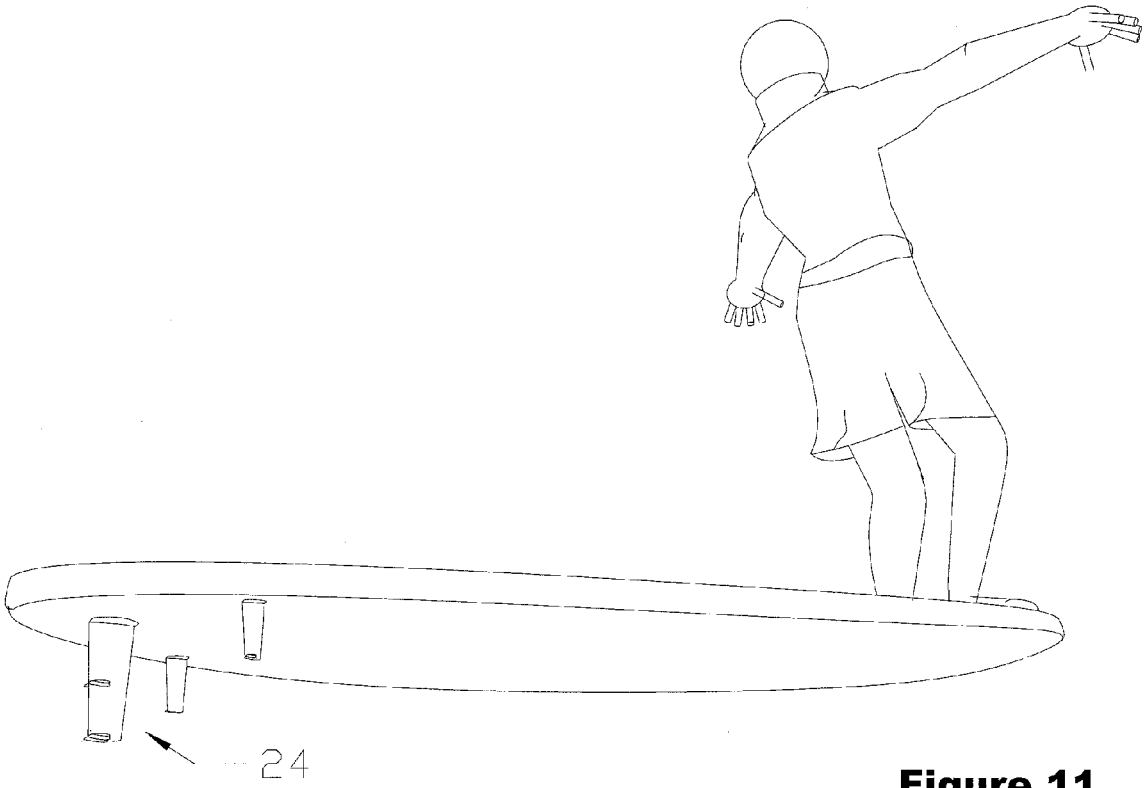
FIG. 11 is a perspective view of not only a surfer in a position on the nose of the surfboard typical of the maneuver called noseriding and alternative embodiments of the invention.

FIG. 9 shows a third embodiment 24 of the invention, this third embodiment with longer-spanned planar winglets 25 placed directly at the fin tip 11, and with another pair of winglets 26 placed at mid-fin span. Such horizontally arranged, larger planform, mid-span winglets increase lift in the vertical direction, reduce mid-span fin downwash, but increase drag to some extent. But the greater horizontal surface area and thus the greater vertical lift and vertical stability of this embodiment give the surfer or watercraft rider a greater horizontal lifting surface, which despite the penalty in drag, assists riders' movement forward on a surfboard from the take-off stance depicted in FIG. 10 to a point forward on the board such as in noseriding, as shown in FIG. 11. As a rider moves from the rear of the board toward the front, the tail of the board tends to lift upwardly, which gives the horizontally arranged planar winglets 25 and 26 greater lift in the downward direction, stabilizing the board, and facilitating noseriding. The placement of planar winglets 25 at the fin tip 11 promotes lift and decreases tip-vortex drag, but exposes the planar winglets to damage from ground strikes as compared to the vertically upwardly displaced winglets 12 of the first embodiment 1, a compromise suitable for those riders desiring the performance characteristics described.

Still referring to FIG. 9, the winglet placement directly at the fin tip 11 has an important safety benefit. Typical surfboard fins that have a high taper ratio get very thin at the tip, and can cause injuries similar to a blunt spear when the board is thrown onto the surfer or vice versa. Waves pounding against the board can drive the tail into the surfer causing fin injuries, and surfers can be thrown by waves onto the upraised fins of overturned boards, directly onto the fin, casing injuries. The placement of the winglets at the fin tip, on the other hand, protects the surfer somewhat from such injuries. Although the winglets themselves are smaller than typical fin tips, the winglets are arranged in the same plane as the surfboard, mitigating the force with which a wave can throw the board onto the surfer, and the force with which the surfer can strike the board, because the board on edge presents less surface to the coming wave, or when fallen upon while on edge, sinks and absorbs impact, or the board twists. Other than as described, the structure and function of the components of this third embodiment are the same, including the upwardly forwardly displaced fin section 5 resulting in the forward protrusion 6 and cutaway 9, features applied to the winglets as well.

Figure 12:
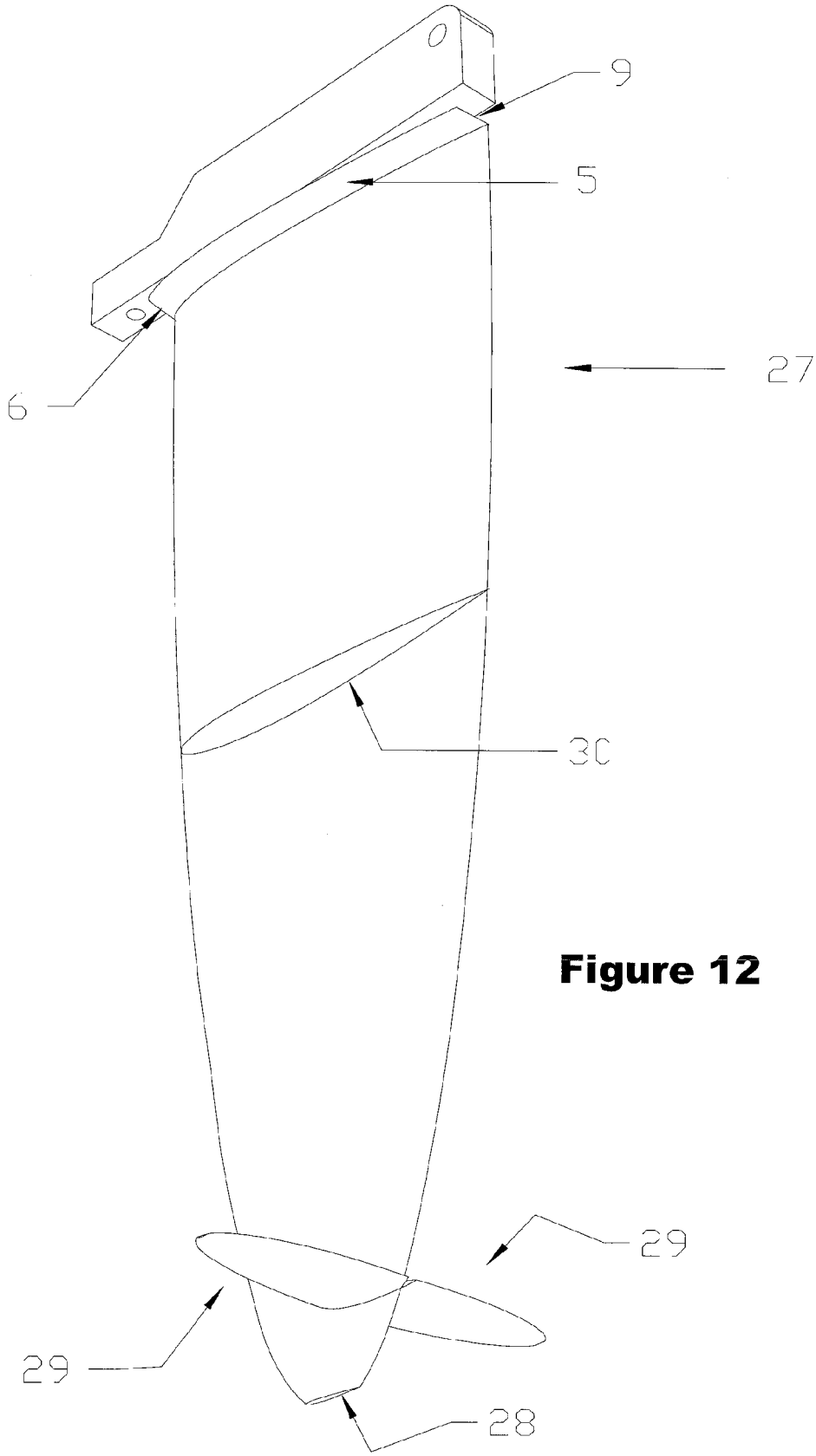
FIG. 12 is perspective view of a further alternative embodiment of the invention, this embodiment with a vertical fin of elliptical planform, with elliptical-planform winglets.

FIG. 12 depicts a fourth embodiment of the invention 27, this with a different planform, an elliptically shaped planform rather than a rectangular planform as in the first embodiment planform 2. Elliptical planforms are particularly effective at producing lift with minimum drag because they minimize concentration of tip vortices. This fourth embodiment has within one winglet chord from the fin tip 28 a pair of elliptical winglets 29, attached at the point of maximum foil section width, and extending to the trailing edge of the fin. As with the first embodiment 1, this fourth embodiment 27 incorporates a high-lift, low drag foil section 30 that maintains laminar flow over a broad angle of attack, which in this particular embodiment is a NACA 0012 foil section, although other high-lift, low drag foil sections with a large effective angle of attack also are suitable. As with the other embodiment of this invention, the fin incorporates a forwardly displaced fin root section 5, which gives the fin both a forward-projecting fin leading edge at the base 6, and a cutaway at the trailing edge of the fin 9. As with other embodiments, this fourth embodiment 27 could be configured with additional pairs of winglets at mid-span, or with larger winglets, either of which configurations would promote noseriding capabilities through increased vertical lift, although with a drag penalty due to the additional surface area. The fin could also be effective without winglets.

Figure 13:
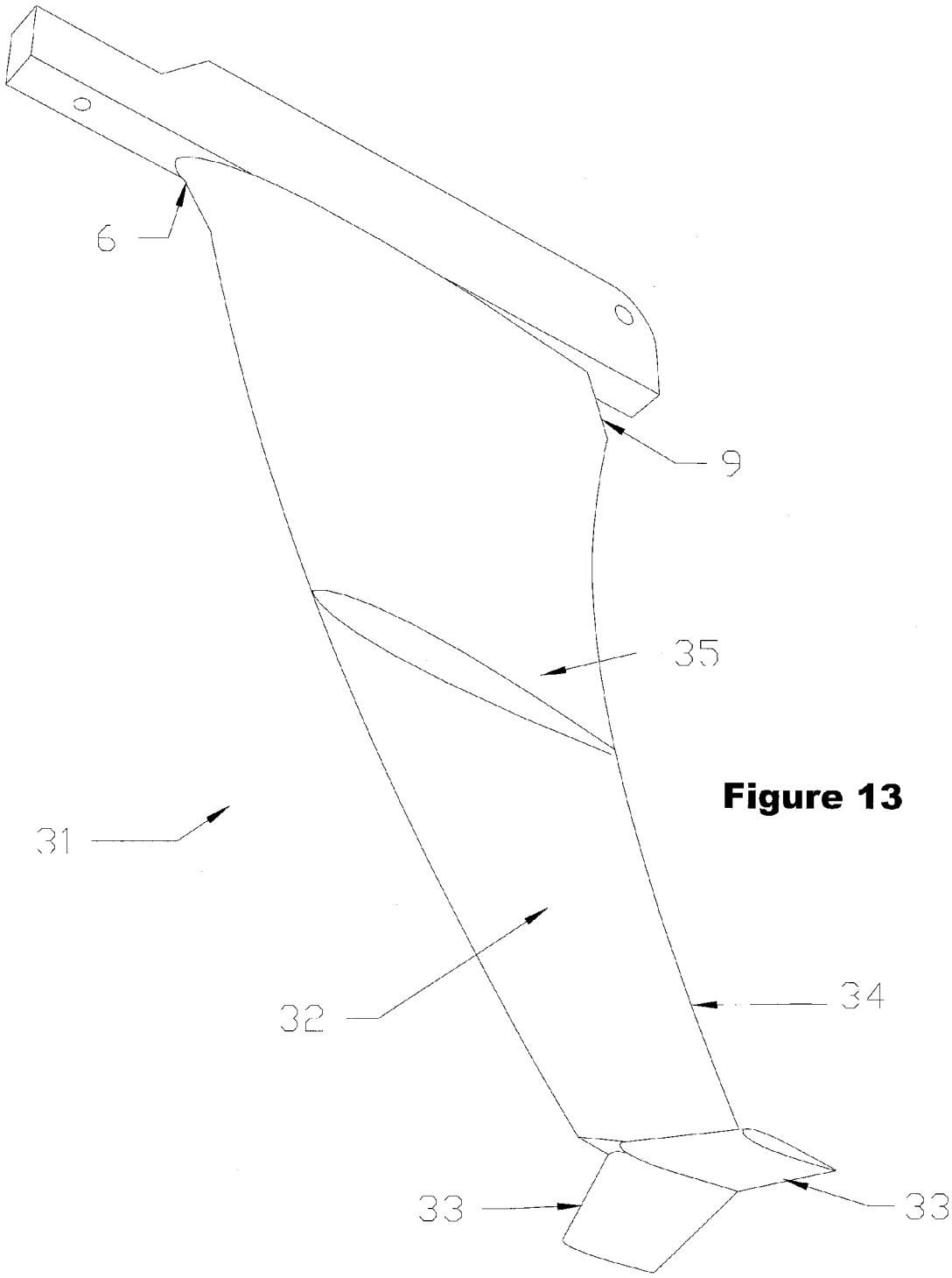
FIG. 13 is a perspective view of a further alternative embodiment of the invention, this with higher sweepback and downwardly outwardly angled wings.
Figure 14:
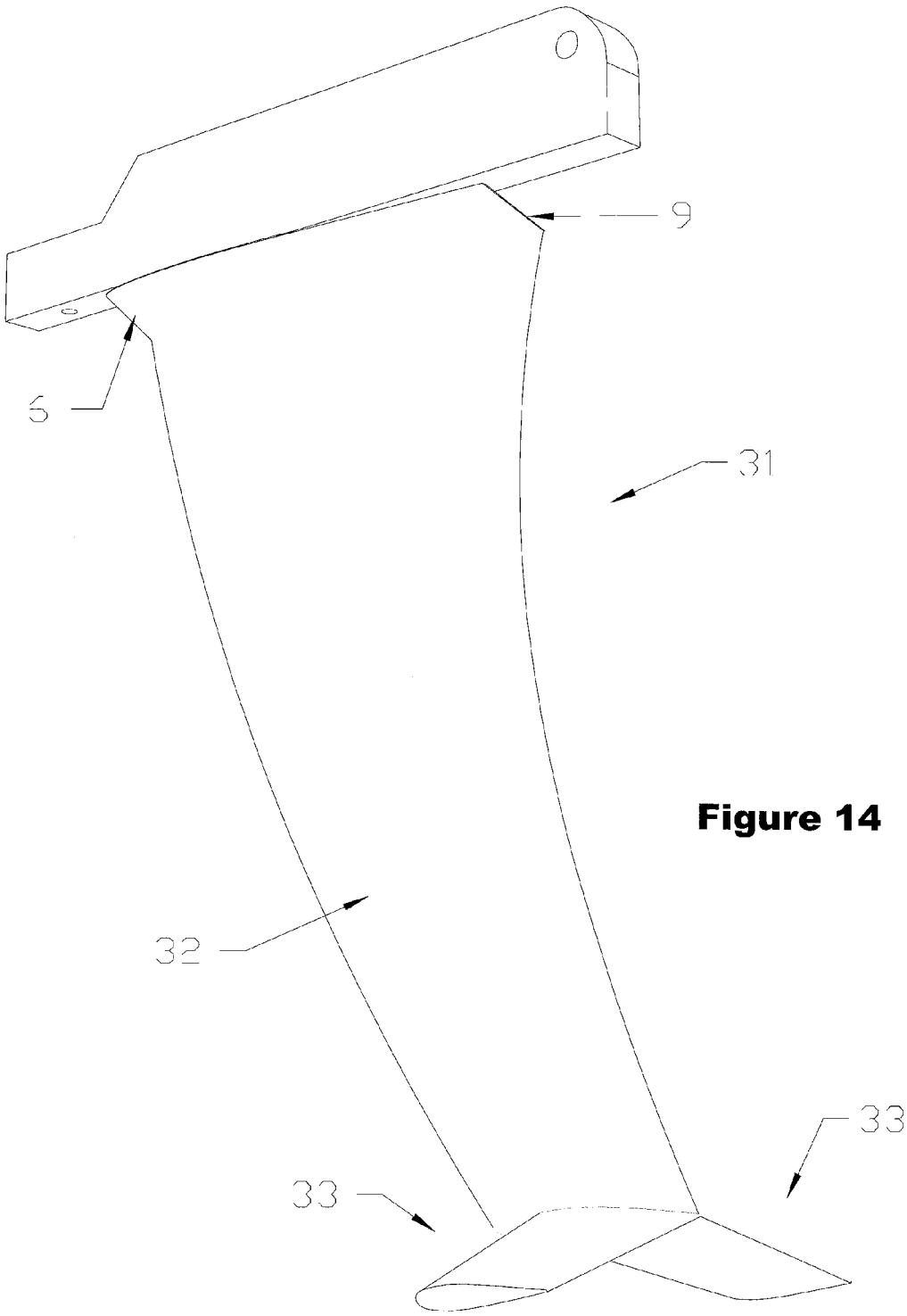
FIG. 14 is a further perspective view of the embodiment of the invention shown in FIG. 12.

FIG. 13 depicts a fifth embodiment of the invention 31 with a more traditional higher-sweepback angle fin planform of 22.6 degrees with greater taper 32 than earlier embodiments, yet still of high aspect ratio, and with planar winglets 33 extending from the trailing edge 34 forward to the maximum width of the foil section at the fin tip, as in earlier embodiments. Also shown is the forward protruding leading edge at the fin root 6 and the corresponding cutaway 9. The high lift, low drag, large-effective-angle-of-attack foil section is shown at 35. FIG. 14 is an alternate perspective view of this fifth embodiment.

Figure 15:
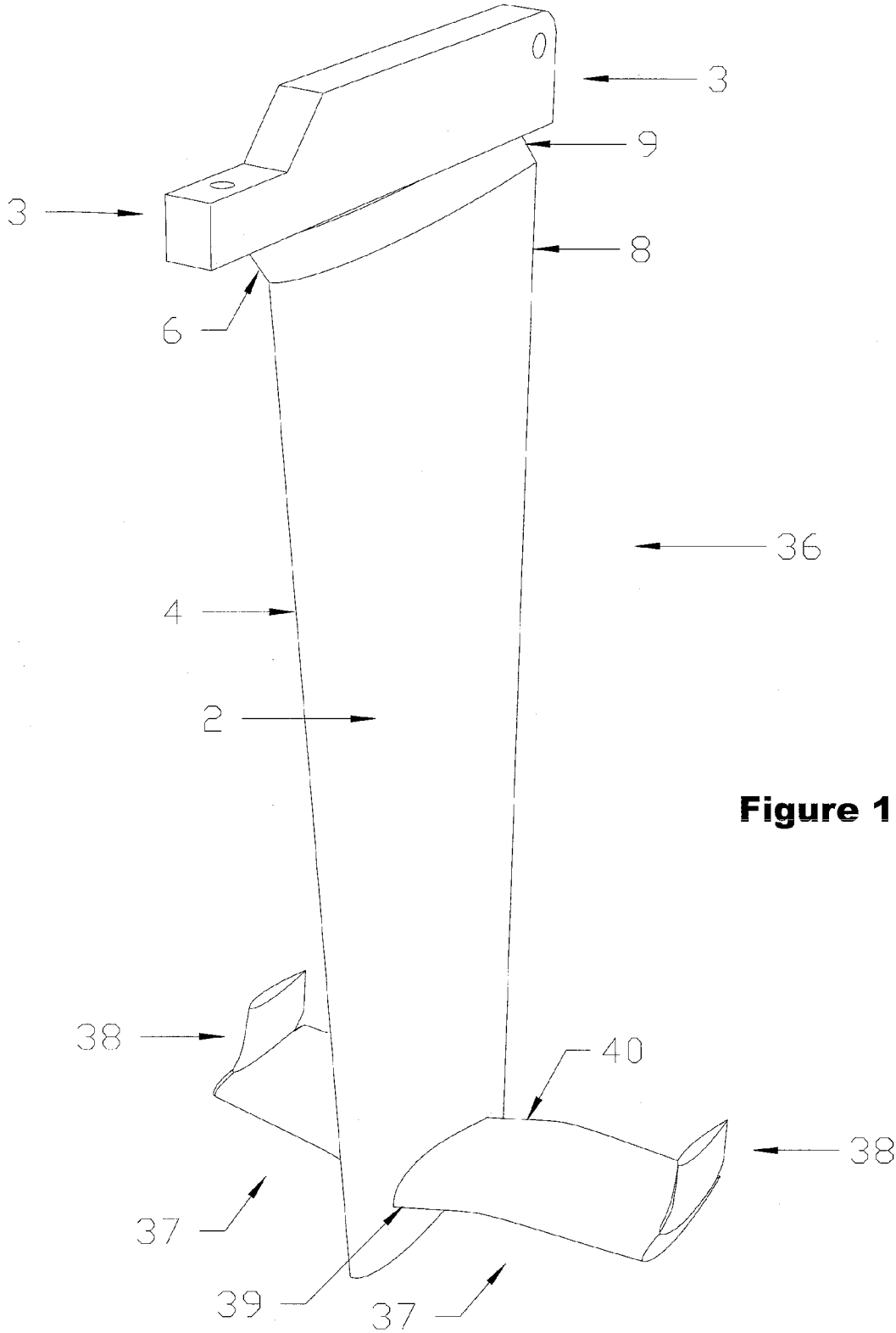
FIG. 15 is a perspective view of the invention in a further alternative embodiment, this with longer spanned winglets which themselves have winglets, resulting in a C-shaped fin.

FIG. 15 shows a sixth embodiment 36 with a C-shaped fin-and-winglet arrangement in which the winglets 37 of extended planar planform themselves have winglet-winglets 38, in order to reduce the winglets' tip-vortex drag. As in earlier embodiments, the fin 2 at the upper end of the leading edge 4 has a forward projection 6 near the fin base 3 with a cutaway 9 at the trailing edge 8 of the fin. As with other embodiments, the winglets themselves have a forward protruding section at the winglet root 39, as well as a cutaway 40 at the winglets' trailing edge. The winglet-winglets incorporate the same design features as the winglets. This particular embodiment demonstrates a longer horizontal planform of the winglets than in earlier embodiments, which provides additional vertical lift and stability, promoting noseriding capabilities, while also reducing tip-vortex drag.

Figure 16:
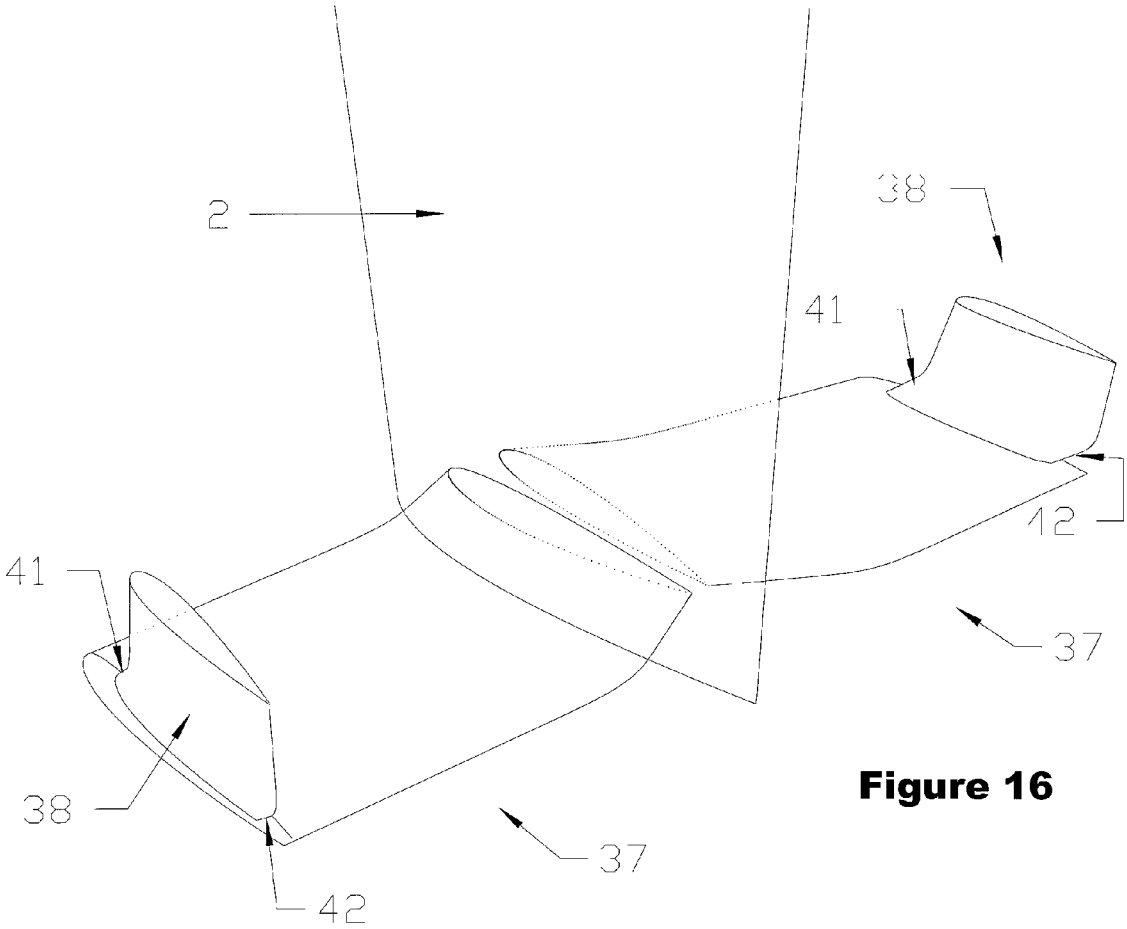
FIG. 16 is a close up partial view of the winglets of the alternative embodiment depicted In FIG. 15.

FIG. 16 is a close-up partial view of the C-shaped winglets 37 attached to the fin planform 2, with winglet-winglets 38, each of which, like fins and winglets of earlier embodiments, incorporates a forward-projecting root section, resulting in a forward projecting leading edge 41 with a cutaway 42 at the trailing edge, features designed to reduce drag.

What is claimed is:

1. A fin for a water sports board comprising:

a fin element having a fin base and a fin root section adjacent said fin base, and having a fin tip with a dimension between said fin root section and said fin tip, said fin element having a fin element leading edge and a fin element trailing edge;

said fin root section being forwardly displaced from a remainder of said fin element, and having a fin root section leading edge projecting beyond said fin element leading edge and a fin root section trailing edge exhibiting a cutaway from said fin element trailing edge;

said fin element having an aspect ratio of 2:1 or greater and a quarter-chord sweepback in a range between 0 and 25 degrees;

said fin element having a fin element cross-section from said fin element leading edge to said fin element trailing edge that is perpendicular to said dimension, said fin element cross-section having a symmetrical foil shape; and said fin tip having a fin tip cross-section from said fin element leading edge to said fin element trailing edge that is perpendicular to said fin element cross-section, said fin tip cross-section having a shape identical to said symmetrical foil shape divided along a line between said fin element leading edge and said fin element trailing edge.

2. A fin as claimed in claim 1 wherein said fin element has opposite sides defining said fin element cross-section, and wherein said fin element cross-sedan has a medmum width between said opposite sides, said fin element comprising at lest one planar winglet having a foil-shaped winglet cross-section with a maximum winglet cross-section width, said at least one winglet being attached to one of said sides of said fin element at a location in a range between 0 and 3 multiples of said medmum winglet cross-section width, upwardly from said fin tip, said at least one winglet extanding outwardly from said one of said sides of said fin element, and extending from said fin tip trailing edge horizontally forwardly toward said fin tip leading edge up to said maximum width of said fin element cross-section.

3. A fin element as claimed in claim 2 wherein said at least one planar winglet comprises a pair of planar winglets respectively disposed at said fin tip at said opposite sides of said fin element.

4. A fin element claimed in claim 3 comprising an additional pair of planar winglets, each having a foil-shaped additional winglet cross-section, said additional pair of planar winglets being respectively ached at said opposite sides of said fin element substantially midway along said dimension.

5. A fin element claimed in claim 3 wherein each winglet in said pair of planar winglets has a winglet trailing edge and a winglet leading edge with a winglet tip therebetween, and wherein said fin element comprises a pair of planar winglet-winglets each having a foil-shaped winglet-winglet cross-section having a maximum winglet-winglet cross-section width, said winglet-winglets being respectively attached to said winglets at a location in a range between 0 and 3 multiples of said maximum winglet-winglet cross-section width inwardly from said tip of said winglet, each winglet-winglet extending upwardly from the tip of the winglet to which it is attached and extending from the trailing edge of the winglet to which it is attached forwardly toward the leading edge of the winglet to which it is attached, to said maximum winglet cross-section width.

6. A fin element as claimed in claim 1 having a shape in a further fin element cross-section that is substantially trapezoidal, said further fin element cross-section being perpendicular to said fin element cross-section and containing said dimension and extending between said fin element leading edge and said fin element trailing edge.

7. A fin element as claimed in claim 1 wherein said fin tip has a further fin tip cross-section that is rounded, said further fin tip cross-section being perpendicular to said fin tip cross-section.

8. A fin for a water sports board comprising:

a fin element having a fin base and a fin root section adjacent said fin base, and having a fin tip with a dimension between said fin root section and said fin tip, said fin element having a fin element leading edge and a fin element trailing edge;

said fin root section being forwardly displaced from a remainder of said fin element, and having a fin root section leading edge projecting beyond said fin element leading edge and a fin root section trailing edge exhibiting a cutaway from said fin element trailing edge;

said fin element having an aspect ratio of 2:1 or greater and a quarter-chord sweepback in a range between 0 and 25 degrees;

said fin element having a fin element cross-section from said fin element leading edge to said fin element trailing edge that is perpendicular to said dimension, said fin element cross-section having a symmetrical foil shape;

said fin element cross-section having a maximum width and said fin element having opposite sides defining said fin element cross-section;

said fin tip having a fin tip cross-section from said fin element leading edge to said fin element trailing edge that is perpendicular to said fin element cross-section; and at least one planar winglet having a foil-shaped winglet cross-section and having a winglet chord length, said at least one planar winglet being attached at one of said sides of said fin element at a location substantially equal to said winglet chord length upwardly from said fin tip, said at least one wing let extending outwardly from one of said sides of said fin element from said fin tip trailing edge horizontally forwardly toward said fin tip leading edge to said maximum width of said fin element cross-section.

9. A fin element as claimed in claim 8 wherein said at least one planar winglet comprises a pair of planar winglets respectively disposed at said fin tip at said opposite sides of said fin element.

10. A fin element as claimed in claim 9 comprising an additional pair of planar winglets, each having a foil-shaped additional winglet cross-section, said additional pair of planar winglets being respectively attached at said opposite sides of said fin element substantially midway along said dimension.

11. A fin element as claimed in claim 9 wherein each winglet in said pair of planar winglets has a winglet trailing edge and a winglet leading edge with a winglet tip therebetween, and wherein said fin element comprises a pair of planar winglet-winglets each having a foil-shaped winglet-winglet cross-section having a maximum winglet-winglet cross-section width, said winglet-winglets being respectively attached to said winglets at a location in a range between 0 and 3 multiples of said maximum winglet-winglet cross-section width inwardly from said tip of said winglet, each winglet-winglet extending upwardly from the tip of the winglet to which it is attached and extending from the trailing edge of the winglet to which it is attached forwardly toward the leading edge of the winglet to which it is attached, to said maximum winglet cross-section width.

* * * * *